405-131 SR

6/5/87 OR 4,671,701

United States Patent [19]

Elliott

[11] Patent Number: 4,671,701

[45] Date of Patent: Jun. 9, 1987

[54] METHOD AND APPARATUS FOR PREVENTING MUD SLIDES

[75] Inventor: Curtis Elliott, 350 Glenview Dr., Apt. #8, San Francisco, Calif. 94131

[73] Assignee: Curtis Elliott, San Francisco, Calif.

[21] Appl. No.: 723,823

[22] Filed: Apr. 16, 1985

[51] Int. Cl.[4] ..... E02D 3/11; E02D 17/20

[52] U.S. Cl. ..... 405/131; 405/258; 165/45; 219/277; 219/213

[58] Field of Search ..... 405/131, 37, 258, 234; 165/45; 219/213, 277, 278; 60/641.2

[56] References Cited

U.S. PATENT DOCUMENTS

| | | | |
|---|---|---|---|
| 3,045,099 | 7/1962 | Bowman et al. | 219/277 |
| 3,114,243 | 12/1963 | Winters | 405/37 |
| 3,668,368 | 6/1972 | Moldskred | 219/213 |
| 3,699,685 | 10/1972 | Scott | 405/131 X |
| 4,204,106 | 5/1980 | Colten | 219/213 |
| 4,314,772 | 2/1982 | Lestraden | 219/213 X |

FOREIGN PATENT DOCUMENTS

| | | | |
|---|---|---|---|
| 0914718 | 3/1982 | U.S.S.R. | 405/131 |
| 0927900 | 5/1982 | U.S.S.R. | 405/131 |

*Primary Examiner*—Dennis L. Taylor

*Attorney, Agent, or Firm*—Cushman, Darby & Cushman

[57] ABSTRACT

Method and apparatus for preventing mud slides comprising determining an area of soil to which to apply heat to evaporate water accumulation therein; determining, as a function of water drainage and water accumulation, a desired rate of water evaporation to maintain rigidity of the soil; and applying the determined amount of heat to the soil thereby to prevent mud slides. A series of electrical heating units are deployed strategically in the soil, and are energized by controlled amounts of energy in accordance with the level of a feedback signal from respective sensors located in the respective heating units. Mud slides may be prevented by determining a specific pattern in the area subjected to mud slides in which to deploy a series of heating units so as to form a rigid barrier which holds in place compliant soil in proximity to the rigid barrier.

5 Claims, 3 Drawing Figures

METHOD FOR PREVENTING MUD SLIDES

METHOD AND APPARATUS FOR PREVENTING MUD SLIDES

BACKGROUND OF THE INVENTION

This invention pertains to a method and apparatus for preventing mud slides resulting from excess water accumulation in soil. More specifically, the invention relates to a method and apparatus for evaporating water accumulations by applying heat to the soil using a plurality of heating units arranged in a predetermined pattern.

Mud slides and/or soil displacements resulting from moisture accumulation are long outstanding problems. They cause considerable property damage and pose life-threatening hazards to many communities. Present day solutions to prevent mud slides include the use of dikes or barriers to reroute water flow during heavy rain or other precipitation, or simply covering substantial areas of soil with a plastic sheathe to prevent water accumulation therein. Also, various drains and drain paths have been constructed to remove water from the topsoil as it accumulates, but drain constructions are expensive, and often ineffective as the soil frequently absorbs precipitation before it runs off or drains.

Excess water accumulations can conveniently be evaporated by ground heaters inserted in the soil. Ground heaters, however, are known in the art, but, to my knowledge, such heaters have never been used for the purpose of preventing mud slides, nor have they been controlled in the fashion which I disclose herein to provide for their efficient utilization. U.S. Pat. No. 2,235,695 to Ackley shows use of an electrical ground heater for solidifying "quicksand" by evaporating water contained therein prior to injecting a bonding agent therein to stabilize the same. This method is used in the construction industry to stabilize the soil prior to building upon it. U.S. Pat. No. 944,382 to Ross also shows use of an electrical ground heater for insertion into the soil to unthaw or prevent freezing of the same, that is, to loosen the soil, a purpose just the opposite of my invention. I am not aware of any prior art which teaches or suggests the use of ground heaters to stabilize soil for the prevention of mud slides.

It, accordingly, is an objective of the present invention to provide an economical and convenient method and apparatus for attaining and maintaining stabilized soil during periods of precipitation, thereby to protect valuable property including buildings and land, and to reduce life-threatening hazards of risk of mud slides.

It is another objective of the present invention to prevent mud slides and soil displacement due to an excess accumulation of precipitation.

It is a further objective of the present invention to solidify unstable soil that is subject to yielding under static and/or dynamic loads.

It is yet a further objective of the present invention to provide a stable barrier of dry solid earth in an area of unstable compliant soil, thereby to retain compliant soil in a stationary manner so as to prevent movement thereof.

It is yet another objective of the present invention to provide an economical system for evaporating moisture and/or water accumulation in soil without the necessity to expend substantial labor or costly methods each time a period of precipitation ensues.

SUMMARY OF THE INVENTION

In accordance with one aspect of the present invention, a method of preventing mud slides is attained by defining a surface area of earth susceptible to being displaced or becoming compliant due to excess water accumulation; determining, as a function of water drainage and accumulation, a desired rate of water evaporation necessary to sustain soil stability; and applying a predetermined quantity of heat energy to the soil in the defined surface area in order to evaporate the water at a rate commensurate with its accumulation. In the preferred embodiment, a series of electrical heating units are deployed at a specified depth in the soil and are arranged in a predetermined pattern in accordance with the defined area to be maintained in a stable condition.

These and further objects, features and advantages of the present invention will become more readily apparent from the following description when taken in connection with the accompanying drawings which show, for purposes of illustration only, several embodiments in accordance with the present invention.

DETAILED DESCRIPTION OF THE PREFERRED EMBODIMENTS

The invention prevents mud slides by evaporating excess moisture in soil on which there is placed a static or dynamic load. Static loads include the weight of the soil itself or any structure located thereon, while dynamic load may be vehicles or other weighted objects temporarily located on the soil. To achieve this goal, I have devised a method in which I first determine a surface area of earth susceptible to being displaced during periods of precipitation; second, determine, as a function of water drainage, a desired rate of water evaporation for a given amount of water accumulation in order to maintain the water content of the soil below that level which causes yielding of the soil; third, determine the amount of heat energy required to evaporate moisture in the soil at the desired rate of water evaporation; and finally, apply the determined amount of heat energy to the soil in order to maintain the stability thereof. To apply the heat energy, I deploy a series of electrical heating elements strategically placed in a predetermined pattern. In one embodiment of the present invention, equal amounts of energy are applied to each heating element, while, in an alternative embodiment, varied amounts of energy are applied to the respective heating units in accordance with respective desired rates of evaporation near and about the respective heating units. The construction and arrangement of these heating units constitutes a further aspect of my invention.

The heating units may be disposed in a grid-like pattern, i.e., such as an array, or in a serial arrangement so as to form and maintain a rigid barrier of the soil in an area of compliant earth. The barrier may take on a variety of different shapes and forms, dependent upon the specific circumstances under which the invention is employed.

Figure 1:
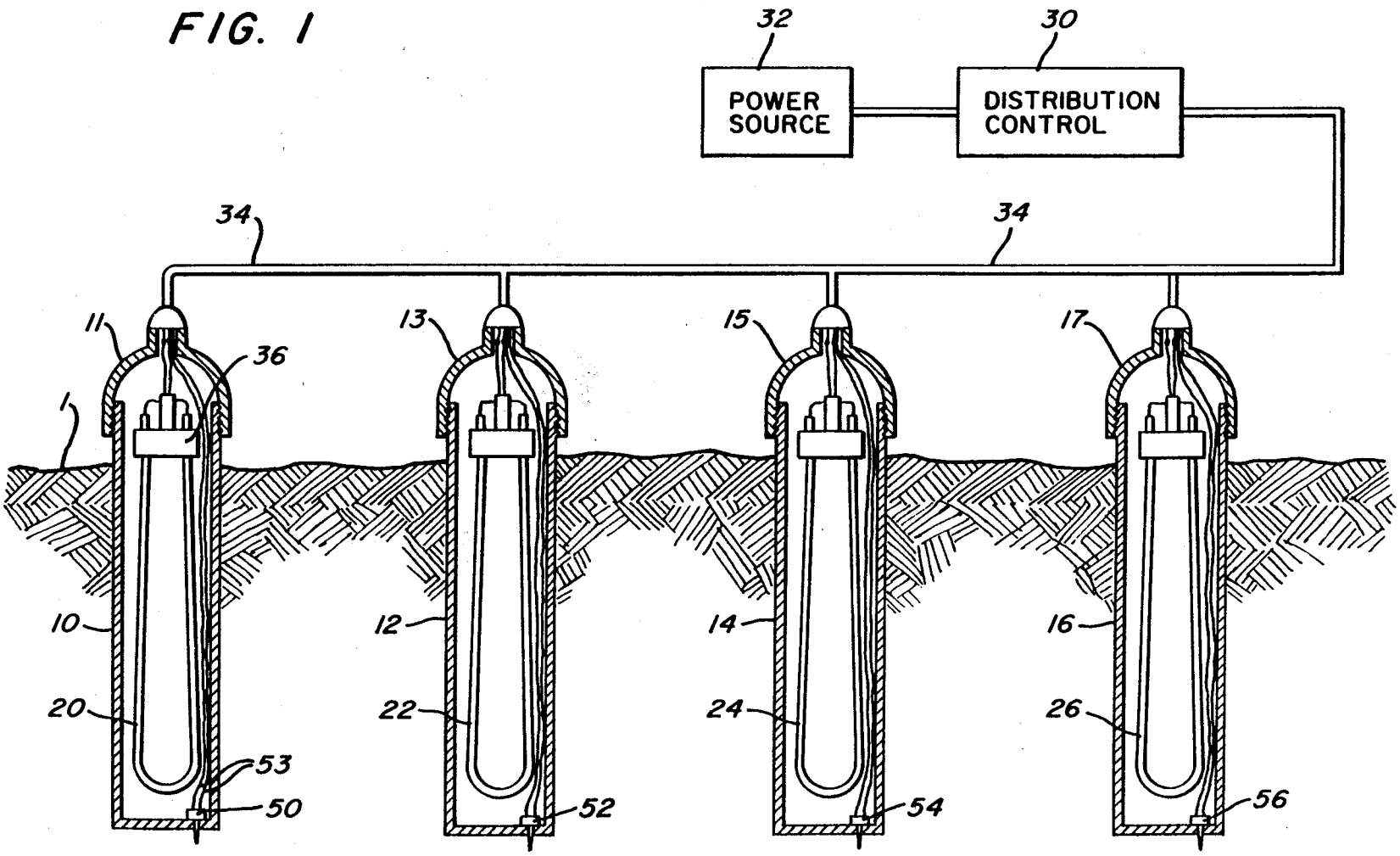
FIG. 1 depicts a series of heating units deployed in a defined area of soil in accordance with one aspect of the present invention.

Referring now to FIG. 1, there is shown a series of ground insertable heating units 10, 12, 14 and 16, each of which contains an electrical, resistive heating element 20, 22, 24 and 26, respectively. Tyically, the heating elements are rated between 500 and 1000 watts, powered by a 120 volt or a 240 volt a.c. supply. In overall construction, the unit 10 is about twenty-two inches long while the resistive heating element 20 is about eighteen inches long. The heating elements are commercially available from many suppliers. They reach a temperature of nearly 3200° F.

During use, the heating units are inserted in the soil 1 spaced apart typically between five to fifteen feet and at a depth dependent on the level of the water table or water absorbtion rate. The depth is usually two-and-one-half to three feet, but could be deeper. Electrical heating elements 20, 22, 24 and 26 are energized by a power source 30 via a distribution control unit 32. The distribution control unit 32 couples each of the heating elements 20, 22, 24 and 26 via power distribution line 34.

As illustrated with respect to the heating element 20, a support plate 36 holds in place the heating element 20 within the tubular heating unit 10, and also serves as an electrical connection junction between the heating element 20 and the distribution line 34. The electrical connection between the heating element 20 and the distribution line 34 is made in a conventional manner. Power source 30 is a conventional DC or AC power supply, such as an electrical utility line or mobile power supply, whereas distribution control unit 32 is a conventional unit for distributing power to the respective heating units 10, 12, 14 and 16, either continuously to each heating element, or in a timed sequence wherein one or more of the heating units is successively energized on a rotating basis.

To improve efficiency in operation, sensors 50, 52, 54 and 56 are provided in each of the heating units 10, 12, 14 and 16, respectively, to provide feedback information to the distribution control 32, thereby to control the amounts of electrical energy supplied to the respective heating units 10, 12, 14 and 16. The sensors sense the moisture content of the soil 1. A conventional moisture sensor may be used to measure the electrical conductivity of the soil 1, which conductivity is proportional to the degree of wetness (or dryness) of the soil. Power supplied to the heating units may be controlled at a level proportional to the degree of wetness of the soil. As shown with respect to the heating unit 10, the sensor 50 includes a probe 51 extending through the bottom portion of the unit 10. A conductor 53 carries a signal representative of the conductivity (e.g., resistivity) of the soil to the distribution control 32 via a carrying conductor in the distribution line 34. Each of the units 10, 12, 14 and 16 includes an identical sensor unit, probe and signal carrying conductor.

In operation, should a particular area of the soil 1 associated with a particular heating unit have a relatively low moisture content such that moisture accumulations need not be evaporated from that location, the distribution control 32 effectively shuts down or reduces power to that particular heating unit so that available electrical energy can best be utilized at other heating units where moisture content is relatively higher. Distribution control 32, to effect such an operation, employs a series of switches, either mechanical or solid state, controlled by individual current sensors coupled to the respective moisture sensors 50, 52, 54 and 56. These current sensors may comprise power transistors which receive, at their respective control inputs (e.g., base input), signals from the respective moisture sensors 50, 52, 54 and 56.

Alternatively, solid state switches may be replaced by relays, wherein the respective control coils thereof respond to signals from the moisture sensors by closing relay contacts thereby to energize the respective heating elements 20, 22, 24 or 26. Of course, if relays are employed, proportional control of power cannot be attained, as in the case of solid state control devices. The arrangement of such an electrical control circuit to turn on and off the respective heating elements or to attain proportional control is conventional and, thus, will not be described herein. Alternatively, a conventionally programmed microprocessor may also perform the tasks of monitoring the sensors and controlling the power supply to the respective heating elements in response to the monitored signals. Thus, the energy applied to the respective heating units may be controlled simply by an on/off switch or energy can be applied at a level commensurate with the level of the signal emanating from the respective moisture sensors.

Figure 2:
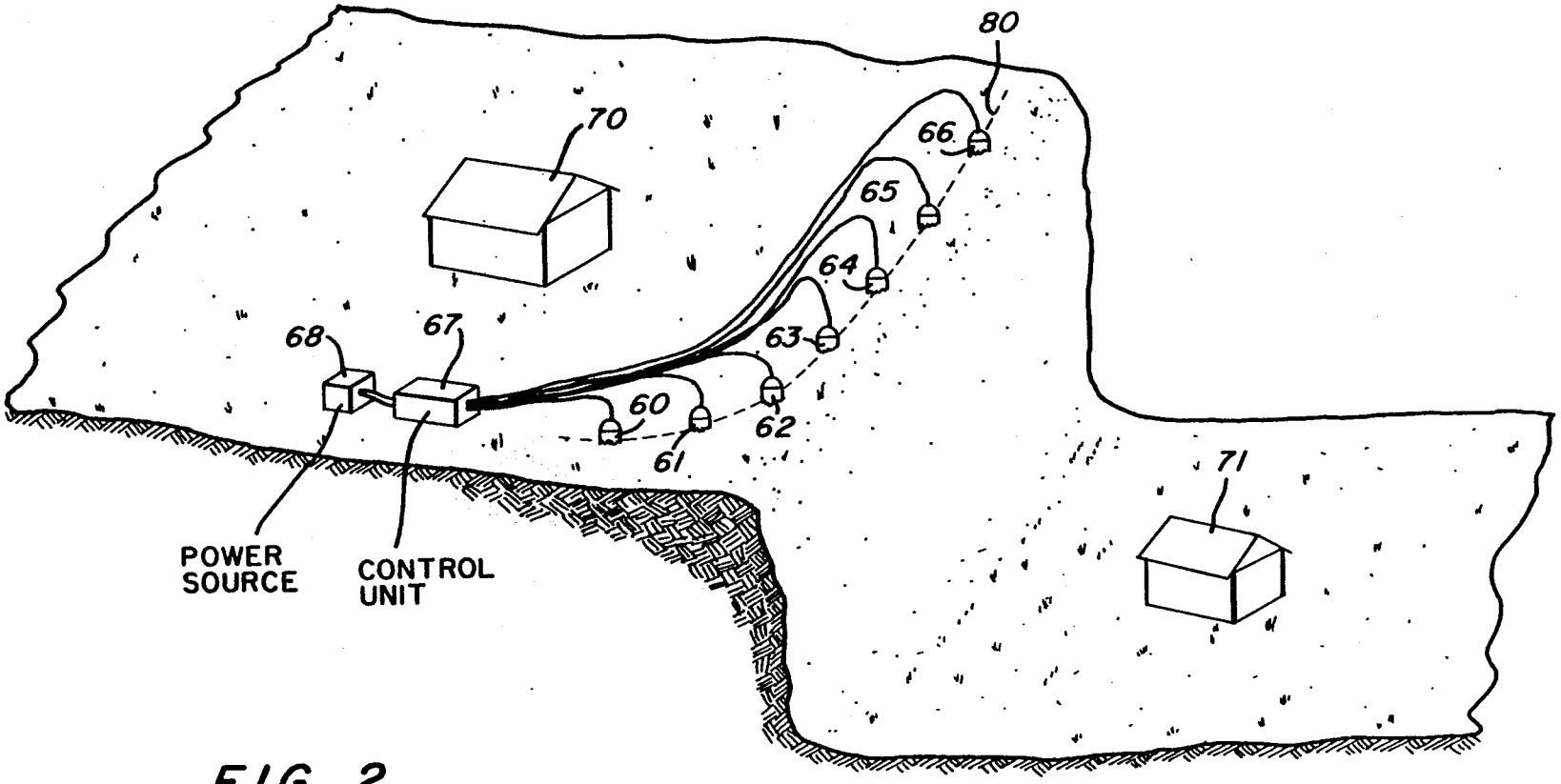
FIG. 2 depicts a deployment of heating units in a manner so as to form a barrier of stable soil about a structure susceptible to damage due to mud slides in accordance with another aspect of the present invention.

FIG. 2 shows an arrangement of heating units 60, 62, 64 and 66 arranged in a barrier around a structure 70. The heating units 60, 62, 64 and 66 are controlled and powered by control unit 67 and power source 68, as described with respect to FIG. 1. Under certain circumstances, only a portion of the defined area of earth 1 need be solidified, although the entire or a substantial portion of the area 1 may become compliant due to water accumulation. The barrier indicated by dashed line 80 essentially forms a rigid wall of earth within the defined area 1 so as to prevent displacement of soil on either side of it, and thereby protects the structure 70 from damage due to soil displacement. Likewise, should the structure reside downhill from an area subject to mud slide, it too can be protected. Such a structure 71 is shown downhill from a barrier 80.

Figure 3:
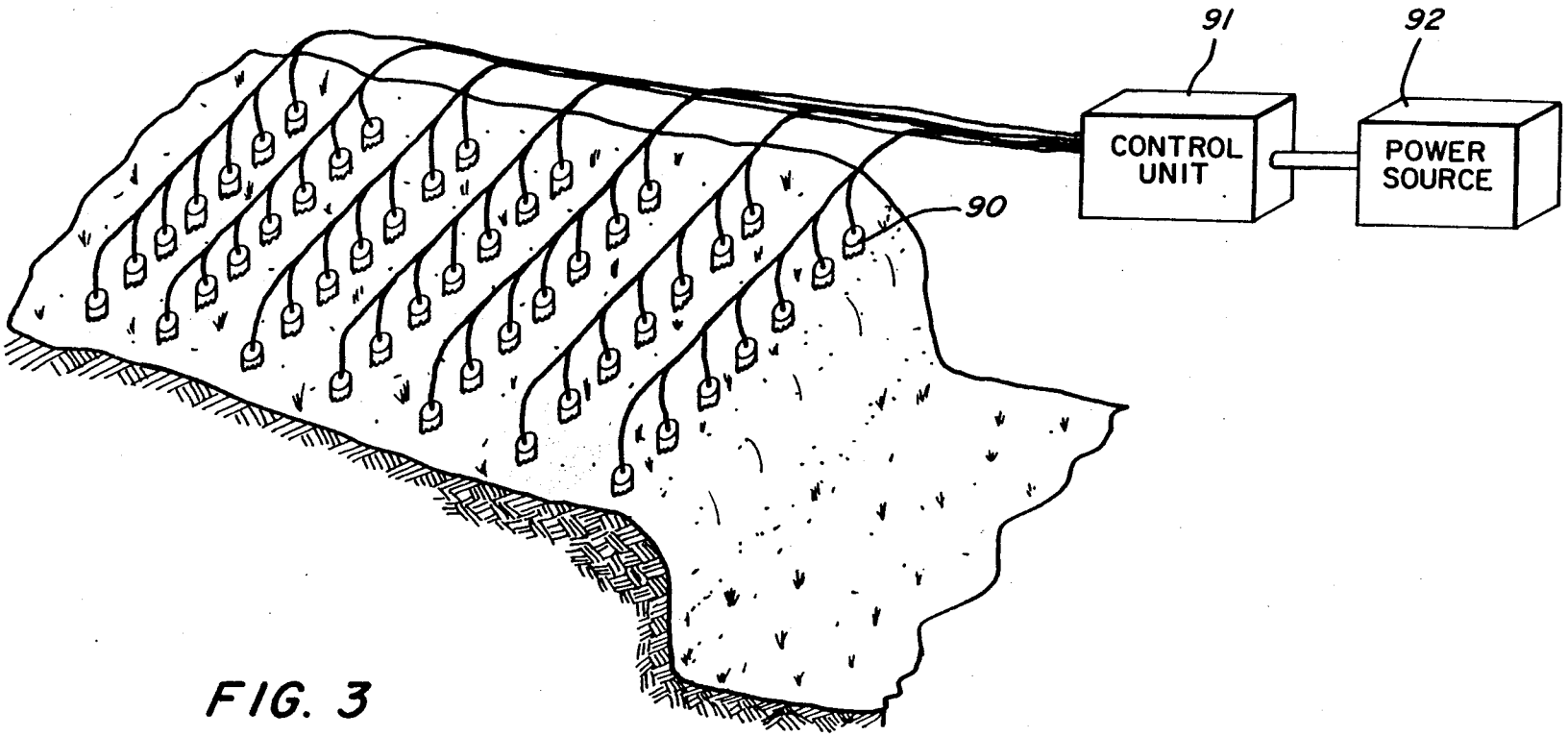
FIG. 3 depicts an array of heating elements disposed in soil to stabilize the same in accordance with yet a further aspect of the present invention.

FIG. 3 depicts a matrix array of identical heating units, one being referenced as unit 90 disposed in a defined area of soil 1. The array of heating units are powered and controlled by control unit 91 and power source 92, which operate in the manner described with respect to FIG. 1. Again, the heating units 90 may be energized with equal amounts of energy or, alternatively, may be supplied on a rotating basis as dictated by the mode of operation of the control unit 90.

In each instance, tests for determining water drainage and accumulation are determined so that the proper amounts of heat energy can be developed and applied to the soil 1. Whether equal or varied amcunts of heat energy are applied to the respective locations in the soil obviously depends upon the uniformity of the soil characteristics. If uniform in character, i.e., drainage and in moisture accumulation, then equal amounts of energy should be applied to the respective heating units in order to maintain rigidity of the land. However, where the ground characteristics lack uniformity, the respective control units vary the amounts of energy in dependence upon the level of the signal emanating from the respective moisture sensors of the heating units in order to attain and maintain uniform rigidity at the respective locations in the desired area of land.

As evident by the above description of illustrative embodiments of my invention, it is apparent that alternative embodiments comprising modifications, adaptations and arrangements can be constructed without departing from the spirit and scope of the invention. The heating units shown are exemplary and need not necessarily comprise electrical heating elements, but instead may be powered from other sources of heat or energy. Although their structure is shown as being cylindrical and adapted for insertion into the earth, heat energy may be applied to the soil by other means. The depth of insertion and spacing of units may vary from that described depending on the circumstances. For example, in soils having high water transmissivity, the units are inserted deeper, and conversely. Also, during heavy precipitation, the heating elements are energized with higher power, and conversely. Further, barriers may be arranged in various configurations around the structures so as to protect them from mud slides, although only a simplified barrier is shown. Accordingly, in view of numerous modifications which can be constructed, I do not restrict my invention to that which is exactly illustrated or described, but include all such arrangements and adaptations which may come within the true scope of my appended claims.

I claim:

1. A method for preventing mud slides employing a series of heating elements in a predetermined pattern, each said heating element generating and releasing a predetermined quantity of heat energy, said method comprising the steps of:

defining a surface area of the earth susceptible to being displaced upon accumulation of moisture;

determining, as a function of water drainage, a desired rate of water evaporation for a given water accumulation in said defined area that is necessary to prevent mud sliding therein;

determining, as a function of the quantity of heat energy of the heating elements and the desired rate of water evaporation, respective locations of said predetermined pattern in said defined surface area at which each said heating element is to be placed;

inserting said heating elements at predetermined depths at said determined locations of said predetermined pattern; and energizing said heating elements with a predetermined amount of energy according to said desired rate of water evaporation whereby to evaporate water accumulation in the aid of preventing mud slides.

2. A method as recited in claim 1, further comprising energizing each said heating element with equal amounts of energy.

3. A method as recited in claim 1, further comprising the step of defining said predetermined pattern as a grid-like pattern in said defined area so as to reduce the likelihood of a mud slide therein.

4. A method as recited in claim 1, further comprising the step of defining said predetermined pattern as a barrier at a location in said defined area to reduce the likelihood of a mud slide therein.

5. A method for preventing mud slides employing a series of heating elements in a predetermined pattern, said heating elements adapted to generate and release heat energy, said method comprising the steps of:

defining a surface area of land susceptible to being displaced upon accumulation of moisture;

determining, as a function of water drainage and accumulation, a desired rate of water evaporation in the defined area which is necessary to attain and maintain rigidity of soil in the defined area;

determining a quantity of heat energy required for evaporating said determined amount of water accumulation; and applying said determined quantity of heat energy to the soil in said defined surface area.

* * * * *